US007382341B2

(12) United States Patent
Park

(10) Patent No.: US 7,382,341 B2
(45) Date of Patent: Jun. 3, 2008

(54) ORGANIC ELECTROLUMINESCENT DEVICE AND DRIVING METHOD THEREOF

(75) Inventor: Joon-Kyu Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 475 days.

(21) Appl. No.: 10/743,900

(22) Filed: Dec. 24, 2003

(65) Prior Publication Data

US 2004/0135521 A1 Jul. 15, 2004

(30) Foreign Application Priority Data

Dec. 31, 2002 (KR) ..... 10-2002-0088383

(51) Int. Cl.
*G09G 3/30* (2006.01)

(52) U.S. Cl. ..... 345/77; 345/76

(58) Field of Classification Search ..... 315/169.3; 345/76–84, 204, 211, 690
See application file for complete search history.

(56) References Cited

U.S. PATENT DOCUMENTS 6,858,991 B2 * 2/2005 Miyazawa ..... 315/169.3

FOREIGN PATENT DOCUMENTS

CN 1216135 A 5/1999
CN 1355664 A 6/2002

* cited by examiner

*Primary Examiner*—Duc Q Dinh
(74) *Attorney, Agent, or Firm*—McKenna, Long & Aldridge LLP

(57) ABSTRACT

An organic electroluminescent device includes a substrate; a gate line on the substrate; a data line crossing the gate line to define a pixel region; a power line substantially parallel to and spaced apart from the gate line; a first switching thin film transistor connected to the gate line and the data line; a first driving thin film transistor connected to the first switching thin film transistor and the power line; a storage capacitor connected to the first driving thin film transistor and the power line; an organic electroluminescent diode connected to the first driving thin film transistor; a gate driver connected to the gate line; a data driver connected to the data line; and a power control driver supplying a power voltage to the power line, the power voltage having a first value during an emitting time section of a single frame and a second value during a rest time section of the single frame.

15 Claims, 4 Drawing Sheets

ORGANIC ELECTROLUMINESCENT DEVICE AND DRIVING METHOD THEREOF

This application claims the benefit of Korean Patent Application No. 2002-88383, filed on Dec. 31, 2002, which is hereby incorporated by reference for all purposes as if fully set forth herein.

BACKGROUND OF THE INVENTION

1. Field of the Invention

The present invention relates to an organic electroluminescent device, and more particularly, to an active matrix organic electroluminescent device including a thin film transistor.

2. Discussion of the Related Art

A cathode ray tube (CRT) has been widely used as a display screen for devices, such as televisions and computer monitors. However, a CRT has the disadvantages of being large, heavy, and requiring a high drive voltage. As a result, flat panel displays (FPDs) that are smaller, lighter, and require less power have grown in popularity. Liquid crystal display (LCD) devices, plasma display panel (PDP) devices, field emission display (FED) devices, and electroluminescence display (ELD) devices are some of the types of FPDs that have been introduced in recent years.

Among various types of FPDs, ELD devices use an electroluminescence phenomenon that light is emitted when a specific voltage is applied to a fluorescent material. ELD devices may either be an inorganic electroluminescence display device or an organic electroluminescence display (OELD) device depending upon the source material used to excite carriers in the device. OELD devices have been particularly popular because they have bright displays, low drive voltages, and can produce natural color images incorporating the entire visible light range. Additionally, OELD devices have a preferred contrast ratio because they are self-luminescent. OELD devices can easily display moving images because they have a short response time of only several microseconds. Moreover, such devices are not limited to a restricted viewing angle as other ELD devices are. OELD devices are stable at low temperatures. Furthermore, their driving circuits can be cheaply and easily fabricated because the circuits require only a low operating voltage, for example, about 5V to 15V DC (direct current). In addition, the process used to manufacture OELD devices is relatively simple.

In general, an OELD device emits light by injecting electrons from a cathode and holes from an anode into an emission layer, combining the electrons with the holes, generating an exciton, and transitioning the exciton from an excited state to a ground state. Since the mechanism by which an OELD device produces light is similar to a light emitting diode (LED), the organic electroluminescence display device may also be called an organic light emitting diode (OLED).

Recently, an active matrix OELD device where a plurality of pixel regions are disposed in the form of a matrix and a thin film transistor (TFT) is disposed in each pixel region is widely used in FPDs. An exemplary active matrix organic electroluminescent device is illustrated in FIG. 1.

FIG. 1 is a circuit diagram of an active matrix organic electroluminescent device according to the related art.

In FIG. 1, a pixel region "P" defined by a gate line 1 and a data line 3 is composed of a switching thin film transistor (TFT) "$T_S$," a driving TFT "$T_D$," a storage capacitor "$C_{ST}$," and an organic electroluminescent (EL) diode "$D_{EL}$." A power line 5 is parallel to and spaced apart from the data line 3. The switching TFT "$T_S$" includes a switching gate electrode connected to the gate line 1, and switching source and switching drain electrodes, and the driving TFT "$T_D$" includes a driving gate electrode and driving source and driving drain electrodes. The switching source and switching drain electrodes are connected to the data line 3 and the driving gate electrode, respectively. The driving source and driving drain electrodes are connected to the power line 5 and the organic EL diode "$D_{EL}$," respectively. The organic EL diode "$D_{EL}$" includes a cathode, an anode, and an organic electroluminescent layer interposed therebetween. The cathode of the organic EL diode "$D_{EL}$" is grounded and the anode of the organic EL diode "$D_{EL}$" is connected to the driving drain electrode. The storage capacitor "$C_{ST}$" is connected to the driving gate and driving source electrodes of the driving TFT "$T_D$."

When a gate signal is applied to the switching gate electrode through the gate line 1, the switching TFT 4 is turned ON and a data signal of the data line 3 is stored in the storage capacitor "$C_{ST}$" through the switching TFT "$T_S$." The data signal is also applied to the driving gate electrode, thereby turning the driving TFT "$T_D$" ON. Thus, a current by a power voltage "$V_{DD}$" of the power line 5 flows through a channel of the driving TFT "$T_D$" and is transmitted to the organic EL diode "$D_{EL}$." As a result, the organic EL diode "$D_{EL}$" emits light in proportion to the current density. The organic EL diode "$D_{EL}$" is a current driving type that the power voltage "$V_{DD}$" has a fixed value and the brightness of light is controlled by the current. Since the driving TFT "$T_D$" may be driven by charges stored in the storage capacitor "$C_{ST}$" even when the switching TFT "$T_S$" is turned OFF, the current through the organic EL diode "$D_{EL}$" is persistent until a next data signal is applied. As a result, light is emitted from the organic EL diode "$D_{EL}$" until a data signal of the next frame is applied.

In the organic electroluminescent device according to the related art, the power line 5 has a fixed voltage from a single power supply and is parallel to the data line 3. Since there is no means to control a power voltage "$V_{DD}$" of each power line 5, each organic EL diode "$D_{EL}$" emits light for an excessive time and can be overheated. As a result, lifetime is shortened and light efficiency is reduced. Moreover, since resistance value of the organic EL diode "$D_{EL}$" can be changed and a response speed can be reduced, motion blurring phenomenon in which the previous image affects the next image and can cause non-uniformity of display quality can occur.

SUMMARY OF THE INVENTION

Accordingly, the present invention is directed to an organic electroluminescent device that substantially obviates one or more of problems due to limitations and disadvantages of the related art.

An advantage of the present invention is to provide an organic electroluminescent device where non-uniformity of display quality and motion blurring are prevented.

Another advantage object of the present invention is to provide an organic electroluminescent device where light efficiency is improved by adjusting an emitting time of an organic electroluminescent diode.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, an organic electroluminescent device includes: a substrate; a gate line on the substrate; a data line crossing the gate line to define a pixel region; a power line parallel to and spaced apart from the gate line; a first switching thin film transistor connected to the gate line and the data line; a first driving thin film transistor connected to the first switching thin film transistor and the power line; a storage capacitor connected to the first driving thin film transistor and the power line; an organic electroluminescent diode connected to the first driving thin film transistor; a gate driver connected to the gate line; a data driver connected to the data line; and a power control driver supplying a power voltage to the power line, the power voltage having a first value during an emitting time section of a single frame and a second value during a rest time section of the single frame.

In another aspect of the present invention, an organic electroluminescent device includes: a display panel including a gate line, a data line and an organic electroluminescent diode; a gate driver supplying a gate signal to the gate line; a data driver supplying a data signal to the data line; a power control driver supplying a power voltage to the power line, the power voltage having a first value during an emitting time section of a single frame and a second value during a rest time section of the single frame.

In another aspect, a driving method of an organic electroluminescent device having a driving circuit and a display panel includes: applying a gate signal to a switching thin film transistor of the display panel; applying a data signal to a driving thin film transistor of the display panel through the switching thin film transistor; applying a first value of a power voltage to an organic electroluminescent diode during an emitting time section of a single frame; applying a second value of the power voltage to the organic electroluminescent diode during a rest time section of the single frame gate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, example of which is illustrated in the accompanying drawings. Wherever possible, similar reference numbers will be used throughout the drawings to refer to the same or like parts.

Figure 1:
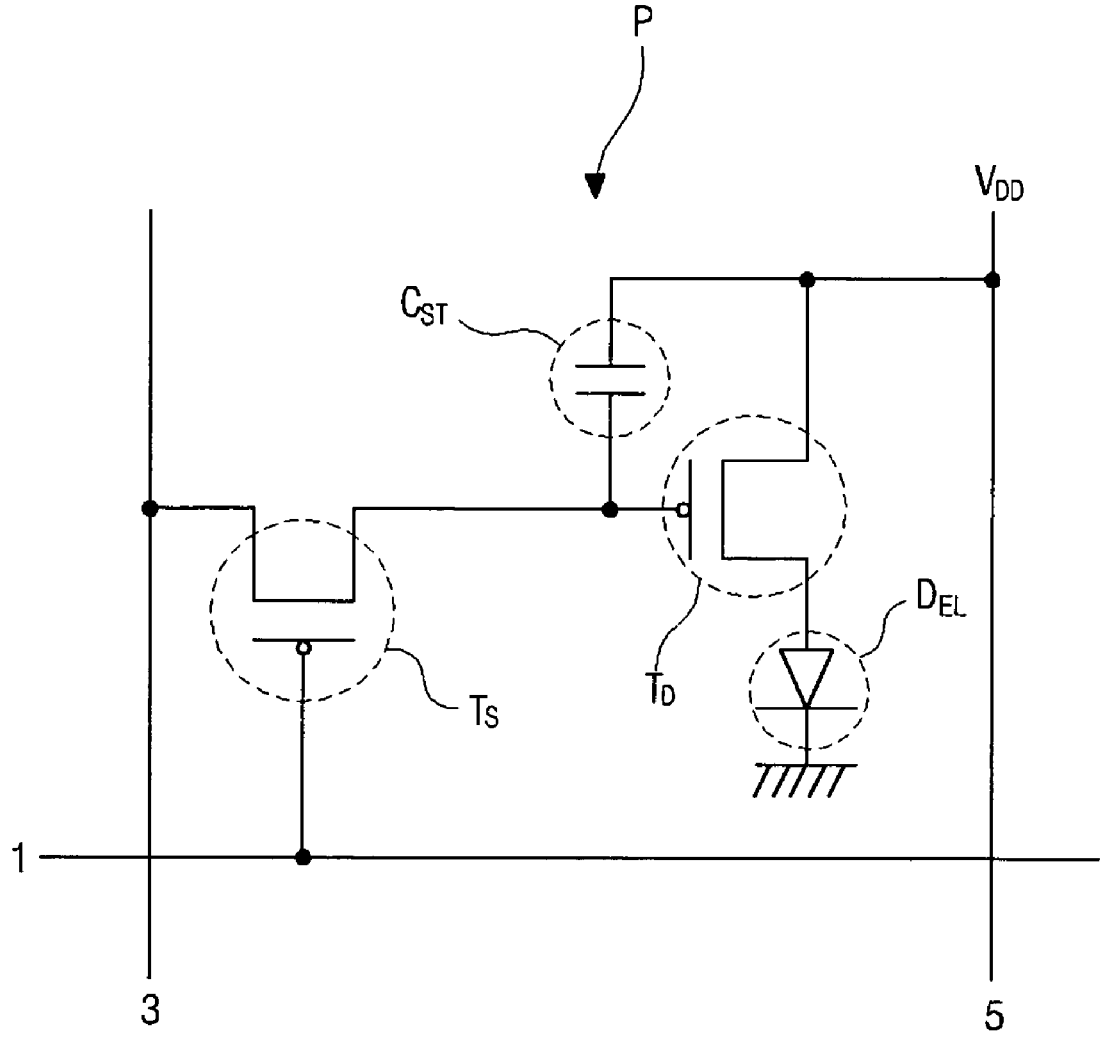
(related art) FIG. 1
FIG. 1 is a circuit diagram of an active matrix organic electroluminescent device according to the related art.
Figure 2:
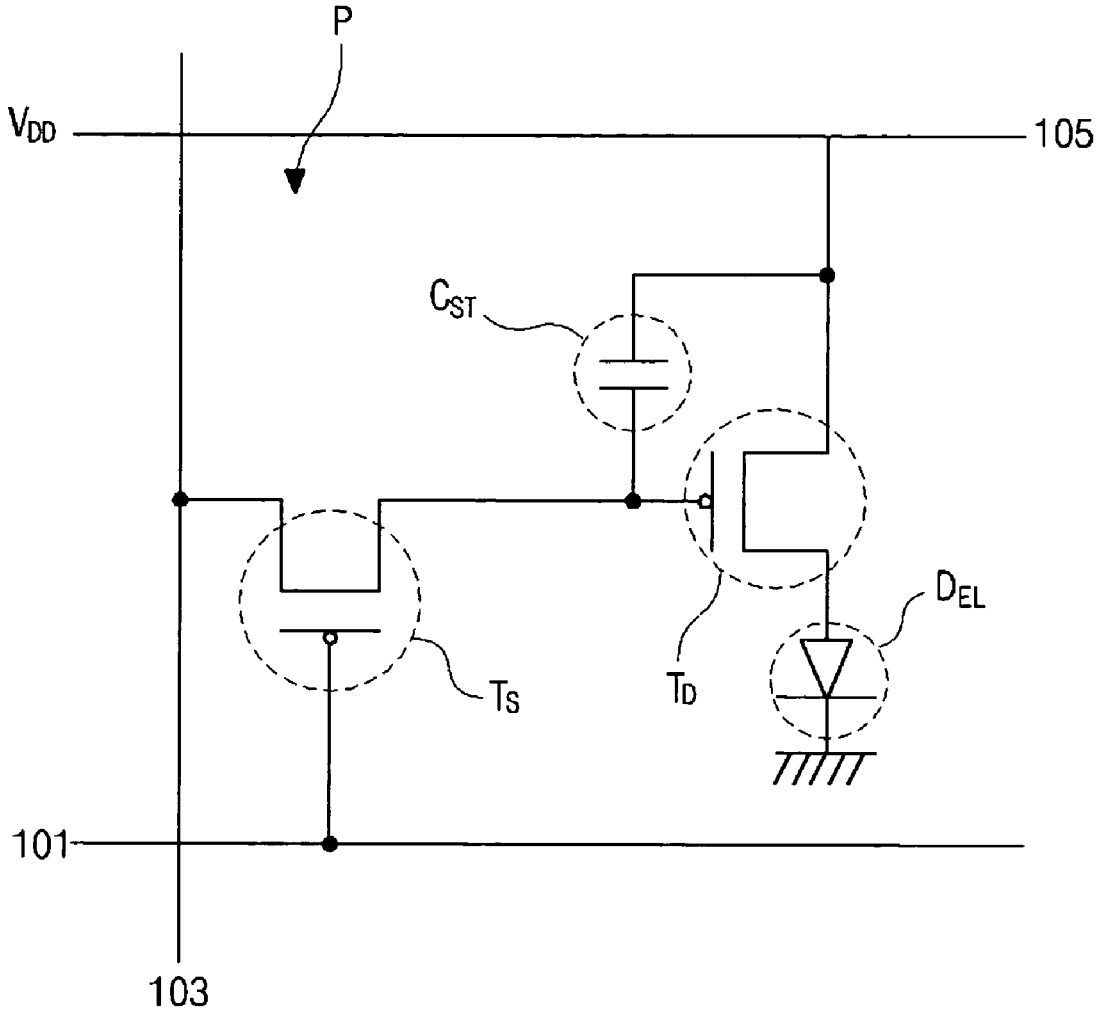
FIG. 2 is a schematic circuit diagram showing one pixel region of an organic electroluminescent device according to an embodiment of the present invention.

FIG. 2 is a schematic circuit diagram showing one pixel region of an organic electroluminescent device according to an embodiment of the present invention.

In FIG. 2, a pixel region "P" is defined by a gate line 101 and a data line 103 crossing each other. Even though not shown in FIG. 2, pixel regions "P" are disposed in a matrix. A power line 105 is substantially parallel to and spaced apart from the gate line 101. A switching thin film transistor (TFT) "$T_S$" including a switching gate electrode, a switching source electrode and a switching drain electrode, a driving TFT "$T_D$" including a driving gate electrode, a driving source electrode and a driving drain electrode, a storage capacitor "$C_{ST}$" and an organic electroluminescent (EL) diode "$D_{EL}$" are formed in the pixel region "P." The switching gate electrode is connected to the gate line 101 and the switching source electrode is connected to the data line 103. The switching drain electrode is connected to the driving gate electrode. The driving drain electrode is connected to an anode of the organic EL diode "$D_{EL}$," and the driving source electrode is connected to the power line 105. A cathode of the organic EL diode "$D_{EL}$" is grounded. The storage capacitor "$C_{ST}$" is connected to the driving gate electrode and the driving source electrode.

A gate signal, an ON/OFF signal of the switching TFT "$T_S$," is outputted through the gate line 101 and a data signal, an image signal, is outputted through the data line 103. A power voltage "$V_{DD}$" is outputted through the power line 105 and a current by the power voltage "$V_{DD}$" flows through the organic EL diode "$D_{EL}$." Accordingly, the organic EL diode "$D_{EL}$" is a current driving type where a device functions by a current. The power voltage "$V_{DD}$" is periodically applied to the power line 105 in one frame. To obtain this periodic power voltage "$V_{DD}$," the organic electroluminescent device (ELD) of the present invention includes a power control driver (not shown in FIG. 2) connected to the power lines 105.

Figure 3:
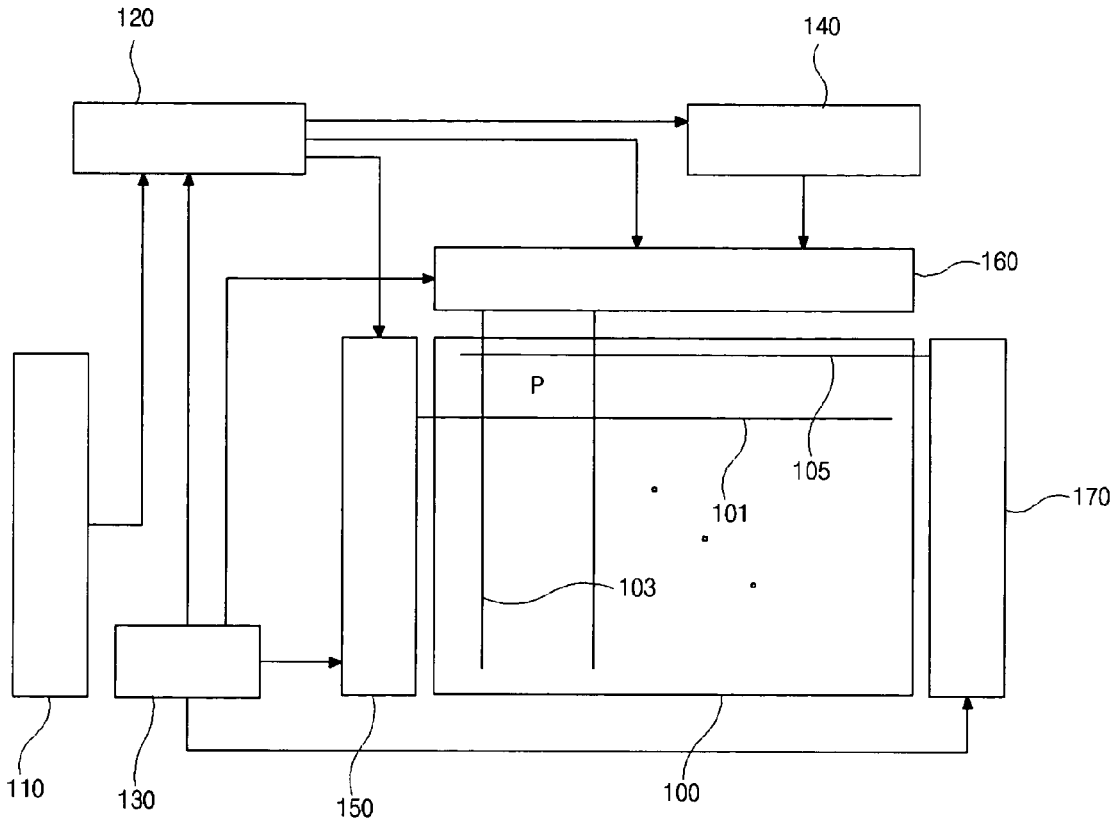
FIG. 3 is a schematic block diagram showing an organic electroluminescent device according to an embodiment of the present invention.

FIG. 3 is a schematic block diagram showing an organic electroluminescent device according to an embodiment of the present invention.

In FIG. 3, an organic electroluminescent device (ELD) includes a display panel 100 and a driving circuit. The display panel 100 has a plurality of pixel regions "P," which are illustrated in FIG. 2. The driving circuit includes an interface 110, a timing controller 120, a power block 130, a gamma voltage generator 140, a gate driver 150, a data driver 160 and a power control driver 170. A source of image signal is transmitted to the interface 110 from an external circuit (not shown). The source of image signal includes several clock signals and RGB (red, green, blue) signals. The timing controller 120 generates a synchronized gate control signal and a synchronized data control signal from the clock signals and the RGB signals. The gate control signal and the data control signal are outputted to the gate driver 150 and the data driver 160, respectively. The gate control signal includes a driving pulse signal for a switching thin film transistor (TFT) "$T_S$" (of FIG. 2). The power block 130 outputs several driving voltages for the driving circuit and the display panel 100. The driving voltages include an ON voltage for an organic electroluminescent (EL) diode "$D_{EL}$" (of FIG. 2). The ON voltage transmitted to the power control driver 170 does not have an OFF section. The gamma voltage generator 140 selects an image signal according to the RGB signal and transmits the selected image signal to the data driver 160.

The gate driver 150 maybe disposed at a first side of the display panel 100 to be connected to a plurality of gate lines 101. The gate driver 150 receives the gate control signal including the driving pulse signal for a switching TFT "$T_S$" (of FIG. 2) and sequentially transmits gate signals to the plurality of gate lines 101 in each frame. The data driver 160 may be disposed at a second side of the display panel 100 to be connected to a plurality of data lines 103. The data driver 160 receives the data control signal and the image signal and transmits data signals corresponding to the gate signals to the plurality of data lines 103.

The power control driver 170 may be disposed at a third side of the display panel 100 to be connected to a plurality of power lines 105. Since the plurality of power lines 105 may be formed parallel to the plurality of gate lines 101, the power control driver 170 can be disposed opposite to the gate driver 150. The power control driver 170 processes the ON voltage for an organic electroluminescent (EL) diode "$D_{EL}$" (of FIG. 2) to have a periodic OFF section in each frame. Accordingly, a power voltage "$V_{DD}$" (of FIG. 2) has periodic high and low voltages in each frame, thereby the organic EL diode "$D_{EL}$" (of FIG. 2) periodically emitting light in each frame. That is, the power control driver 170 adjusts an emitting time of the organic EL diode "$D_{EL}$" (of FIG. 2).

Figure 4:
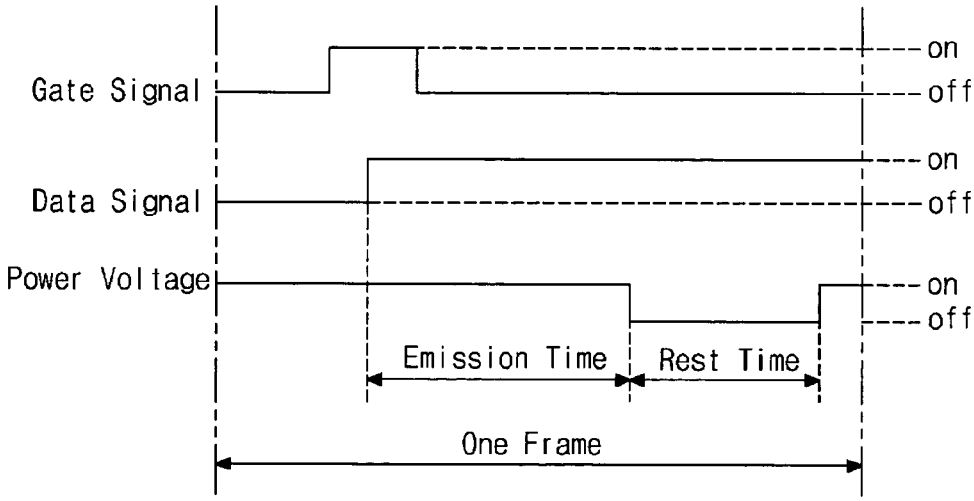
FIG. 4 is a timing chart showing a gate signal, a data signal and a power voltage for one pixel region in one frame according to an embodiment of the present invention.

FIG. 4 is a timing chart showing a gate signal, a data signal and a power voltage for one pixel region in one frame according to an embodiment of the present invention.

In FIG. 4, a power voltage has an ON value (high voltage) in an emission time section and an OFF value (low voltage) in a rest time section during one frame. Accordingly, an organic EL diode "$D_{EL}$" (of FIG. 2) emits light during the emitting time and does not emit light during the rest time for one frame.

An operation of an organic electroluminescent device (ELD) according to the present invention will be illustrated with reference to FIGS. 2 to 4.

The switching TFT "$T_S$" is turned ON by the gate signal of the gate line 101, and the data signal of the data line 103 is transmitted to the storage capacitor "$C_{ST}$" and the driving gate electrode. Thus, the driving TFT "$T_D$" is turned ON and the power voltage "$V_{DD}$" of the power line 105 is transmitted to the organic EL diode "$D_{EL}$." Since the power voltage has the ON value, the organic EL diode "$D_{EL}$" emits light. The driving TFT "$T_D$" keeps the turn-ON state due to charges stored in the storage capacitor "$C_{ST}$" even when the switching TFT "$T_S$" is turned OFF. However, while the power voltage "$V_{DD}$" of the power line 105 has the OFF value, the organic EL diode "$D_{EL}$" is turned OFF and light is not emitted. Accordingly, the organic EL diode "$D_{EL}$" repeats an emitting operation and a non-emitting operation in each frame.

Even though two TFTs "$T_S$" and "$T_D$" are formed in the pixel region "P" in the embodiment of FIG. 2, four TFTs can be formed in a pixel region "P" in another embodiment.

Figure 5:
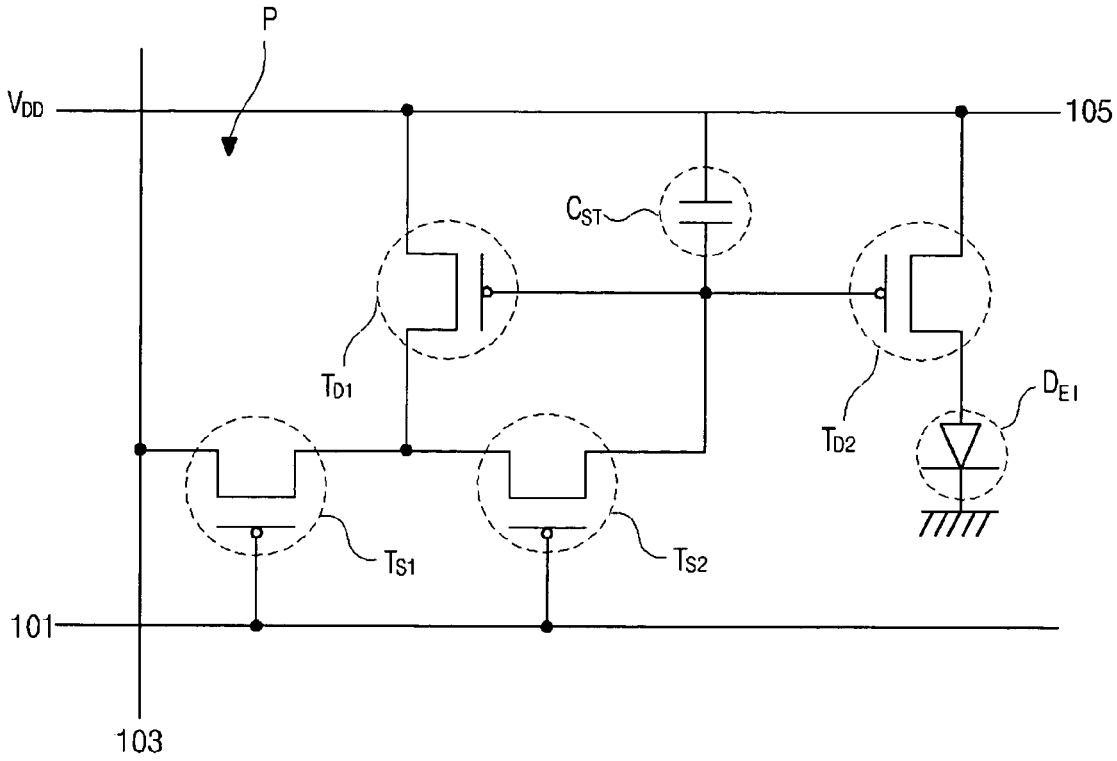
FIG. 5 is a schematic circuit diagram showing one pixel region of an organic electroluminescent device according to another embodiment of the present invention.

FIG. 5 is a schematic circuit diagram showing one pixel region of an organic electroluminescent device according to another embodiment of the present invention.

In FIG. 5, a gate line 101 crosses a data line 103 to define a pixel region "P." A power line 105 is substantially parallel to and spaced apart from the gate line 101. First and second switching thin film transistors (TFTs) "$T_{S1}$" and "$T_{S2}$," first and second driving TFTs "$T_{D1}$" and "$T_{D2}$," a storage capacitor "$C_{ST}$" and an organic electroluminescent (EL) diode "$D_{EL}$" are formed in the pixel region "P." The first switching TFT "$T_{S1}$" includes a first switching gate electrode, a first switching source electrode and a first switching drain electrode. The second switching TFT "$T_{S2}$" includes a second switching gate electrode, a second switching source electrode and a second switching drain electrode. The first driving TFT "$T_{D1}$" includes a first driving gate electrode, a first driving source electrode and a first driving drain electrode. The second driving TFT "$T_{D2}$" includes a second driving gate electrode, a second driving source electrode and a second driving drain electrode.

The first and second switching gate electrodes are connected to the gate line 101. The first switching source electrode is connected to the data line 103 and the first switching drain electrode is connected to the second switching source electrode. The first driving drain electrode is connected to the first switching drain electrode and the second switching source electrode. The first driving gate electrode is connected to the second switching drain electrode and the second driving gate electrode. The second driving source electrode is connected to the first driving source electrode and the power line 105. The second driving drain electrode is connected to an anode of the organic EL diode "$D_{EL}$." A cathode of the organic EL diode "DEL" is grounded. A first electrode of the storage capacitor "$C_{ST}$" is connected to the first and second driving source electrodes, and a second electrode of the storage capacitor "$C_{ST}$" is connected to the first and second driving gate electrodes.

The first and second switching TFTs "$T_{S1}$" and "$T_{S2}$" are turned ON by a gate signal of the gate line 101, and a data signal of the data line 103 is transmitted to the first and second driving TFTs "$T_{D1}$" and "$T_{D2}$." The second driving TFT "$T_{D2}$" is turned ON by the data signal, and a power voltage "$V_{DD}$" of the power line 105 is transmitted to the organic EL diode "$D_{EL}$." The power voltage "$V_{DD}$" has an ON value (high voltage) in an emitting time section and an OFF value (low voltage) in a rest time section during one frame. Accordingly, the organic EL diode "$D_{EL}$" repeats an emitting operation and a non-emitting operation in one frame.

An organic electroluminescent device of the present invention includes a power control driver processing an ON voltage for an organic electroluminescent diode to have a periodic OFF section in each frame, thereby the organic electroluminescent diode repeating emitting and non-emitting operations in each frame. Since the organic electroluminescent diode heated up during the emitting operation is cooled down during the non-emitting operation, the lifetime of the organic electroluminescent device is lengthened and light efficiency is improved. Moreover, since a black state is maintained during the non-emitting operation, contrast ratio of moving images is improved. In addition, since the organic electroluminescent device has a rest time (non-emitting operation) in each frame, motion blurring phenomenon is prevented and brightness uniformity is improved. Furthermore, aperture ratio is improved by forming a power line parallel to a gate line.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic electroluminescent device, comprising:

a substrate;

a gate line on the substrate;

a data line crossing the gate line to define a pixel region;

a power line substantially parallel to and spaced apart from the gate line;

a first switching thin film transistor connected to the gate line and the data line;

a first driving thin film transistor connected to the first switching thin film transistor and the power line;

a storage capacitor connected to the first driving thin film transistor and the power line;

an organic electroluminescent diode connected to a drain terminal of the first driving thin film transistor, wherein the organic electroluminescent device emits light during the emitting time section and does not emit light during the rest time section;

a gate driver connected to the gate line;

a data driver connected to the data line; and a power control driver supplying a power voltage to a source terminal of the first driving thin film transistor through the power line, the power voltage having an On value during an emitting time section of a single frame and an Off value during a rest time section of the single frame, wherein the first driving thin film transistor is turned on when the On value and the Off value are applied to the organic electroluminescent diode during the emitting time section and the rest time section, respectively.

2. The device according to claim 1, wherein the gate driver is disposed at a first side of the substrate, wherein the data driver is disposed at a second side adjacent to the first side, wherein the power control driver is disposed at a third side opposite to the first side.

3. The device according to claim 1, wherein the first driving thin film transistor has a driving gate electrode, a driving source electrode and a driving drain electrode, wherein the storage capacitor is connected to the driving gate electrode.

4. The device according to claim 1, further comprising a second switching thin film transistor connected to the first switching thin film transistor and a second driving thin film transistor connected to the first driving thin film transistor and the second switching thin film transistor.

5. An organic electroluminescent device, comprising:

a display panel including a gate line, a data line, a switching thin film transistor connected to the gate line and the data line, a driving thin film transistor and an organic electroluminescent diode, wherein gate, source and drain terminals of the driving thin film transistor are connected to the switching thin film transistor, a power line and the organic electroluminescent diode, respectively;

a gate driver supplying a gate signal to the gate line;

a data driver supplying a data signal to the data line;

a power control driver supplying a power voltage to the power line, the power voltage having an On value during an emitting time section of a single frame and an Off value during a rest time section of the single frame, wherein the driving thin film transistor is turned on when the On value and the Off value are applied to the organic electroluminescent diode during the emitting time section and the rest time section, respectively, wherein the power line is substantially parallel to and spaced apart from the gate line.

6. The device according to claim 5, further comprising a power block supplying an ON voltage to the power control driver, wherein the ON voltage has one value in the single frame.

7. The device according to claim 6, wherein the power control driver processes the ON voltage to be the power voltage.

8. The device according to claim 5, wherein the display panel further includes a storage capacitor connected to the driving thin film transistor and the power line.

9. The device according to claim 8, wherein the gate signal and the data signal are applied to the switching thin film transistor.

10. A driving method of an organic electroluminescent device having a driving circuit and a display panel, comprising:

applying a gate signal to a switching thin film transistor of the display panel;

applying a data signal to a driving thin film transistor of the display panel through the switching thin film transistor;

applying an On value of a power voltage through a source terminal of the driving transistor to an organic electroluminescent diode that is connected to a drain terminal of the driving transistor during an emitting time section of a single frame;

applying an Off value of the power voltage through the source terminal of the driving transistor to the organic electroluminescent diode during a rest time section of the single frame, wherein the driving thin film transistor is turned on when the On value and the Off value are applied to the organic electroluminescent diode during the emitting time section and the rest time section, respectively.

11. The method according to claim 10, wherein the driving circuit includes a gate driver, a data driver and a power control driver.

12. The method according to claim 11, wherein the gate signal is supplied from the gate driver, wherein the data signal is supplied from the data driver, wherein the power voltage is supplied from the power control driver.

13. The method according to claim 12, wherein the gate signal turns on/off the switching thin film transistor, wherein the data signal turns on/off the driving thin film transistor.

14. The device according to claim 5, wherein the power control driver processes an on voltage for the organic electroluminescent diode to have a periodic off section in single frame when the Off value of the power voltage is supplied to the organic electroluminescent diode during the rest time section of the single frame.

15. The method according to claim 10, wherein the power voltage is supplied from the power control driver.

* * * * *